US006823549B1

(12) United States Patent
Hampton et al.

(10) Patent No.: US 6,823,549 B1
(45) Date of Patent: Nov. 30, 2004

(54) ALTERNATING PRESSURE CUSHION WITH INFLATABLE LUMBAR SUPPORT

(76) Inventors: Donna N. Hampton, 1450 Indian Pl., Murfreesboro, TN (US) 37129; William C. Shaw, 5116 Jacobs Hollow Rd., Bradyville, TN (US) 37149

( * ) Notice: Subject to any disclaimer, the term of this patent is extended or adjusted under 35 U.S.C. 154(b) by 0 days.

(21) Appl. No.: 10/437,282

(22) Filed: May 14, 2003

(51) Int. Cl.[7] ..... A47C 27/10; A61G 7/057
(52) U.S. Cl. ..... 5/713; 5/710; 5/691; 297/284.6
(58) Field of Search ..... 5/713, 710, 691, 5/714, 722, 933; 297/284.6

(56) References Cited

U.S. PATENT DOCUMENTS

| | | | | | |
|---|---|---|---|---|---|
| 2,245,909 | A | * | 6/1941 | Enfiajian | 5/710 |
| 3,148,391 | A | * | 9/1964 | Whitney | 5/422 |
| 3,199,124 | A | * | 8/1965 | Grant | 5/713 |
| 3,540,776 | A | * | 11/1970 | Wilson | 297/253 |
| 3,678,520 | A | * | 7/1972 | Evans | 5/713 |
| 3,987,507 | A | | 10/1976 | Hall | |
| 4,017,118 | A | * | 4/1977 | Cawley | 297/284.3 |
| 4,175,297 | A | * | 11/1979 | Robbins et al. | 5/284 |
| 4,267,611 | A | * | 5/1981 | Agulnick | 5/713 |
| 4,729,598 | A | | 3/1988 | Hess | |
| 4,793,651 | A | * | 12/1988 | Inagaki et al. | 297/180.11 |
| 5,243,723 | A | * | 9/1993 | Cotner et al. | 5/710 |
| 5,509,155 | A | * | 4/1996 | Zigarac et al. | 5/655.3 |
| 5,619,764 | A | | 4/1997 | Lopau | |
| 5,893,184 | A | | 4/1999 | Murphy | |
| 6,047,423 | A | * | 4/2000 | Larson | 35/709 |

FOREIGN PATENT DOCUMENTS

| | | |
|---|---|---|
| FR | 2 601 874 | 1/1998 |

* cited by examiner

*Primary Examiner*—Alexander Grosz
(74) *Attorney, Agent, or Firm*—RIchard C. Litman

(57) ABSTRACT

The alternating pressure cushion is a cushion for prevention and treatment of decubitus ulcers in hemodialysis patients, patients who are wheelchair bound, and other persons confined in a seated or reclined position for a prolonged period. The alternating pressure cushion has a back cushion section, a seat cushion section including an inflatable lumbar support, and a leg cushion section, each section having a plurality of air bladder networks. The air bladder networks are arranged so that each provides support when inflated. When one air bladder network is inflated to support the patient, the other air bladder is deflated to relieve pressure from areas of the patient's body. Alternately inflating and deflating the air bladder networks supports the patient without prolonged pressure points.

7 Claims, 4 Drawing Sheets

ALTERNATING PRESSURE CUSHION WITH INFLATABLE LUMBAR SUPPORT

BACKGROUND OF THE INVENTION

1. Field of the Invention

The present invention relates to an air inflatable seat cushion. More specifically, the invention is an alternating pressure cushion for therapeutic or medical use. The cushion is useful for preventing and treating decubitus ulcers in hemodialysis patients and others who are prone to decubitus ulcers from sitting for extended periods while receiving dialysis or other forms of treatment.

2. Description of the Related Art

Decubitis ulcers, more commonly known as pressure sores or bedsores, are a common problem that afflicts people who are debilitated, confined to a bed, or otherwise immobilized. Decubitus ulcers, which are areas of skin and tissue that become ulcerated from pressure caused by lying down in the same position for extended or prolonged periods of time, form when the skin and underlying tissue are pressed between a bone and an external surface, such as a bed or chair. Pressure restricts blood flow to these areas. After a prolonged period the reduced blood flow begins to cause tissue damage that, if left unchecked, may become severe.

Avoiding prolonged pressure to parts of the body can prevent decubitus ulcers. Bed-ridden patients should be moved to relieve pressure points. Also, various cushions, pillows, foam padding and the like can be used to prevent pressure points for bed-ridden patients and patients who are confined to a seated position, such as hemodialysis patients and the wheelchair-bound.

Mattresses have been devised to provide for distribution of pressure and the prevention of bedsores in bed-ridden patients. Mattresses for decubitis relief are often known as "turning mattresses" because they typically employ air bladders or another mechanism to gently turn a bed-ridden patient from side to side, changing the side of the patient's body that is weighted. In addition, cushions for chairs and wheelchairs that reduce or redistribute pressure are known.

Hemodialysis patients present a particular need, since a patient undergoing hemodialysis may be moved through a range of positions, from being seated upright, to a partially reclined position, to being fully reclined. During the hemodialysis session, the patient must remain in the hemodialysis chair for several hours, thus creating a risk of pressure sores. Because the patient may be in a reclined position, there is a risk of pressure sores on the patient's legs, buttocks, and back. Thus, a simple seat cushion is insufficient to protect the patient's legs and back from pressure points.

A turning mattress is not suited to the needs of hemodialysis because a fully recumbent position is not generally preferred, and because the turning of the patient is not desirable while the patient is connected to the intravenous hemodialysis lines. For a hemodialysis situation, a cushion that is segmented to provide pressure relief for the legs, buttocks, and back and that is flexible to accommodate various degrees of recline is needed.

U.S. Pat. No. 3,987,507, issued on Oct. 26, 1976 to M. Hall, discloses a pressure distribution pad assembly for wheelchairs. The pad is formed of a foam material and has regions of greater and lesser density to evenly distribute pressure when a person sits on the pad on a wheelchair. This pad, however, is only a seat pad and provides relief only for the buttocks.

U.S. Pat. No. 4,729,598, issued on Mar. 8, 1988 to J. Hess, describes a patient chair system that includes features to prevent pressure sores. The chair utilizes air sacs to form a support for the buttocks and thighs of a patient to distribute weight and eliminate pressure points. Again, while providing relief to a seated patient, this chair system does not address the needs of a patient who is in either a partially or fully reclined position.

U.S. Pat. No. 5,619,764, issued on Apr. 15, 1997 to H. Lopau, discloses a mattress for decubitus prophylaxis. A kind of "turning mattress," the mattress includes inflatable air chambers that form a pair of longitudinal air cushions. The pair of air cushions, one on each side of the mattress, are separately inflatable and deflatable. In use, each of the pair is alternately inflated and deflated, causing the patient to be turned gently from side to side. Because the patient is turned from side to side, continuous pressure points are avoided and bedsores may be prevented. Although this mattress provides for full body prevention of bedsores, the method of turning a patient from side to side is not suitable for use in a seated position, and in a hemodialysis situation it is preferred not to turn the patient while connected to the intravenous hemodialysis lines. Additionally, because the mattress is designed generally for patients in a recumbent position and not a seated position, it lacks some features which are desirable for patients in a seated position, such as a lumbar support.

French Patent No. 2,601,874, published on Jan. 29, 1988, discloses another air mattress for prevention of bedsores in a bedridden patient. The primary benefit of this mattress appears to be its construction with a material that is highly permeable to water vapor, allowing the mattress to "breathe." Again, this mattress is designed for recumbent bed-ridden patients, and so lacks features that are desirable for seated use.

U.S. Pat. No. 5,893,184, issued on Apr. 13, 1999 to M. Murphy, discloses a pressure reducing backrest cushion with pressure point relief. The cushion is comprised of several air bladders, each filled with a compressible foam material. The foam material provides support in conjunction with air contained within the air bladders. Pressure points may be relieved by letting air escape from one or more of the bladders that support the pressured region. The cushion provides enhanced comfort by the ability to adjust firmness of various portions by expelling air from the bladders. However, once a bladder is deflated it will not re-inflate until the patient has moved or stood up to allow the foam to expand. This cushion, therefore, is not ideally suited for a situation where a patient is confined to a seated or reclined position for an extended period. Also, patient comfort may be compromised by the lack of a lumbar support.

None of the above inventions and patents, taken either singly or in combination, is seen to describe the instant invention as claimed. Thus an alternating pressure cushion solving the aforementioned problems is desired.

SUMMARY OF THE INVENTION

The alternating pressure cushion is a seat cushion for the prevention and treatment of decubitis ulcers in patients who are required to sit in an upright or reclined position for an extended period of time, such as hemodialysis patients undergoing a lengthy treatment. Hemodialysis patients, patients confined to a wheelchair, patients who are bed-ridden, and other patients with limited mobility may use the cushion to provide comfort and to avoid pressure points that cause pressure sores.

The cushion is formed in three sections to provide a back cushion, a seat cushion, and a leg cushion. Each of the sections contains a plurality of air bladders. Air channels connect the air bladders between sections to form air bladder networks, each of which can be inflated and deflated from a single source.

The air bladders are arranged so that each bladder network provides uniform support not dependant on the other bladder networks. In use, the bladder networks are alternately inflated and deflated so that as one is inflated, another is deflated. The alternate inflation of each bladder network allows the patient's weight to be shifted from one network to another network, thereby eliminating prolonged pressure points.

The back cushion has a separately inflatable air bladder that forms a lumbar support region for improved comfort.

Accordingly, it is a principal object of the invention to provide an alternating pressure cushion for the prevention and treatment of pressure sores.

It is another object of the invention to provide an alternating pressure cushion for the prevention and treatment of pressure sores that includes back, seat, and leg support cushions.

It is a further object of the invention to provide an alternating pressure cushion for the prevention and treatment of pressure sores that includes a lumbar support for additional comfort.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
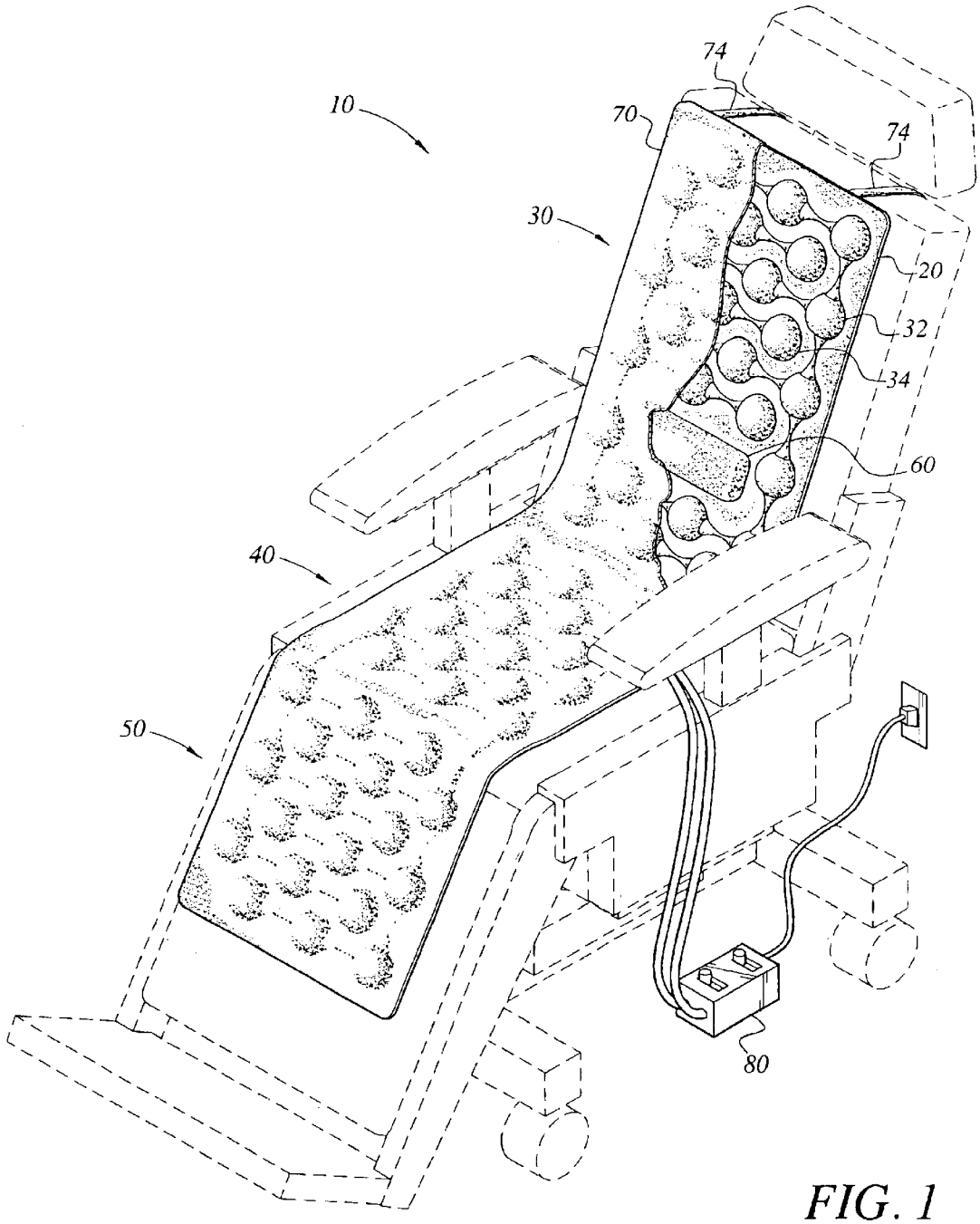
FIG. 1 is an environmental, perspective view of an alternating pressure cushion according to the present invention.

The present invention is an alternating pressure cushion, designated generally as 10 in the drawings. As seen in FIG. 1, the alternating pressure cushion 10 is configured to provide cushion support in a seated or reclined position with a back cushion section 30, a seat cushion section 40, and a leg cushion section 50. The cushion sections are flexibly connected to one another so that the alternating pressure cushion 10 will easily fit a variety of chairs, including hemodialysis chairs and wheelchairs. The alternating pressure cushion 10 provides seat, back, and leg support through a range of positions, from seated upright to fully reclined.

The alternating pressure cushion 10 may include a separate air cushion 20 and slipcover 70. The slipcover 70 may be permanently attached to the air cushion 20, or it may be removable. If removable, the slipcover 20 may be reusable or disposable.

Each of the cushion sections employs a plurality of air bladder networks formed of air bladders and interconnecting air channels. Each air bladder network is provided with means for inflating the air bladder. The air bladder networks are arranged so that each air bladder network may be separately inflated to provide uniform cushion support.

Figure 2:
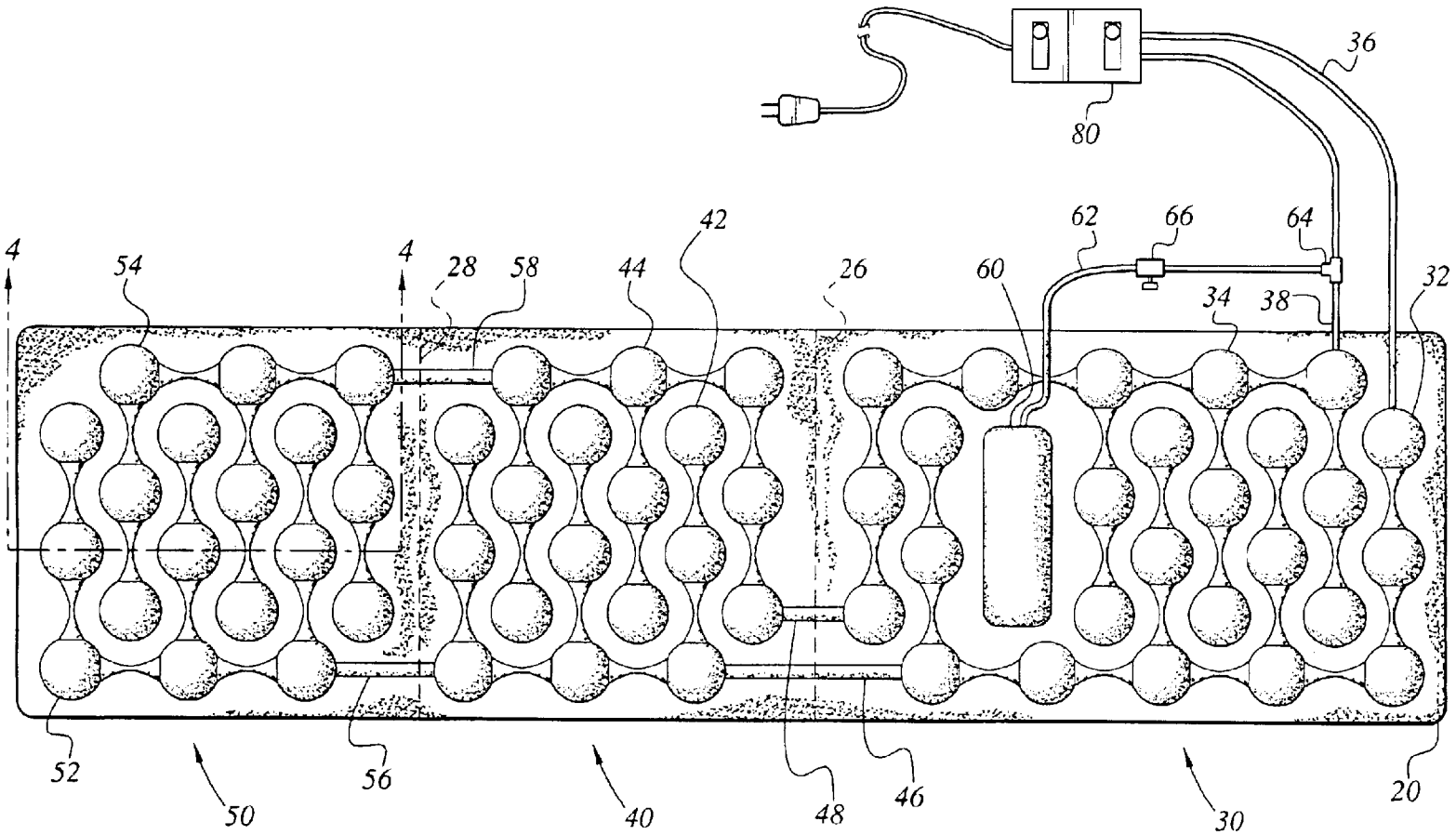
FIG. 2 is a plan view of an alternating pressure cushion according to the present invention.

As seen in FIG. 2, the air cushion 20 may be formed having two independent air bladder networks, arranged to form three distinct cushion sections. The cushion sections are defined by foldable seams 26, 28 so that the alternating pressure cushion 10 may be folded to fit a variety of sitting situations. In a preferred embodiment, the back cushion section 30 has a first back air bladder network 32 and a second back air bladder network 34. Air filling tubes 36, 38, connected to the back air bladder networks 32, 34, allow for inflation of the back air bladder networks 32, 34. In addition to the back air bladder networks 32, 34, the back cushion section 22 includes a lumbar support air bladder 60. The lumbar support air bladder 60 is connected to an air filling tube 62.

The seat cushion section 40 has first and second seat air bladder networks 42, 44. First and second air filling means 46, 48 connect to the first and second seat air bladder networks 42, 44. The air filling means 46, 48 may be air filling tubes. However, it is preferred that the air filling means 46, 48 are air channels, including a first air channel 46 connecting the first seat air bladder network 42 to the first back air bladder network 32, and a second air channel 48 connecting the second seat air bladder network 44 to the second back air bladder network 34.

The leg cushion section 50 has first and second air bladder networks 52, 54. First and second air filling means 56, 58 connect to the first and second leg air bladder networks 52, 54. The air filling means 56, 58 may be air filling tubes. However, it is preferred that the air filling means 56, 58 are air channels, including a first air channel 56 connecting the first leg air bladder network 52 to the first seat air bladder network 42, and a second air channel 58 connecting the second leg air bladder network 54 to the second leg seat bladder network 44.

In the preferred embodiment, the first back air bladder network 32, the first seat air bladder network 42, and the first leg air bladder network 52 are joined by the connecting air channels into a single first air bladder network. Likewise, the second back air bladder network 34, the second seat air bladder network 44, and the second leg air bladder network 54 are joined by the connecting air channels into a single second air bladder network. It can be seen that inflating a back air bladder network causes its adjoining seat and leg air bladder networks to inflate.

Figure 4:
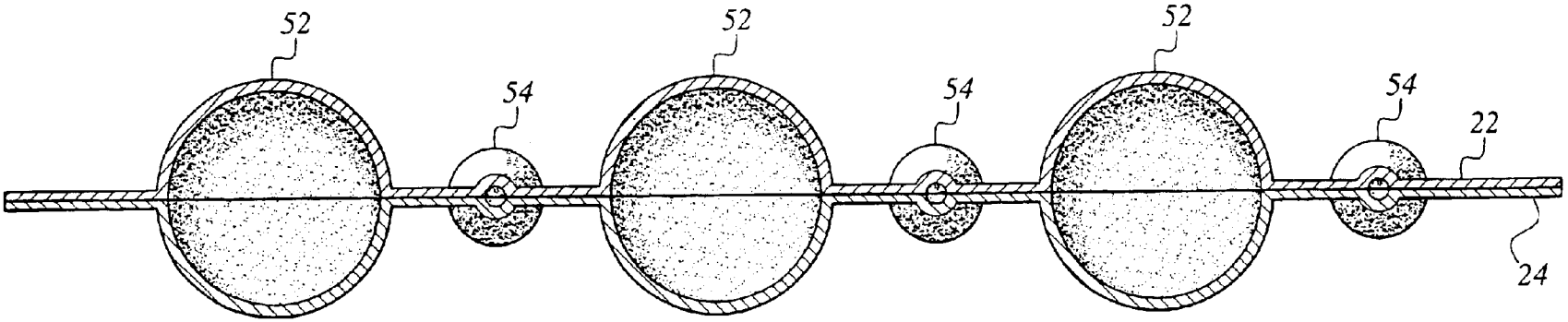
FIG. 4 is a section view along lines 4—4 of FIG. 2.

A preferred method of construction of the alternating pressure cushion 10 is by welding an upper sheet 22 of an air-tight material to a lower sheet 24 of an air-tight material, with welded seams forming the air bladder networks, lumbar support air bladder, air channels, and foldable seams. FIG. 4 shows a cross section of the leg cushion section 50 of the alternating pressure cushion 10, with the upper sheet 22 welded to the lower sheet 24 to form the first and second leg air bladder networks 52,54.

In use, the alternating pressure cushion 10 is connected to an alternating pressure air pump 80. The alternating pressure air pump 80 provides two air pressure sources that are alternately activated. The first air filling tube 32 is connected to one of the air sources, and the second air filling tube 34 is connected to the other. The alternating pressure air pump will first inflate the first air bladder network while deflating the second air bladder network, and then fill the second air bladder network while deflating the first. The lumbar air filling tube 62 connects to either air pressure source by a "T" fitting 64 and a valve 66 to inflate the lumbar supporting air bladder 60.

Figure 3:
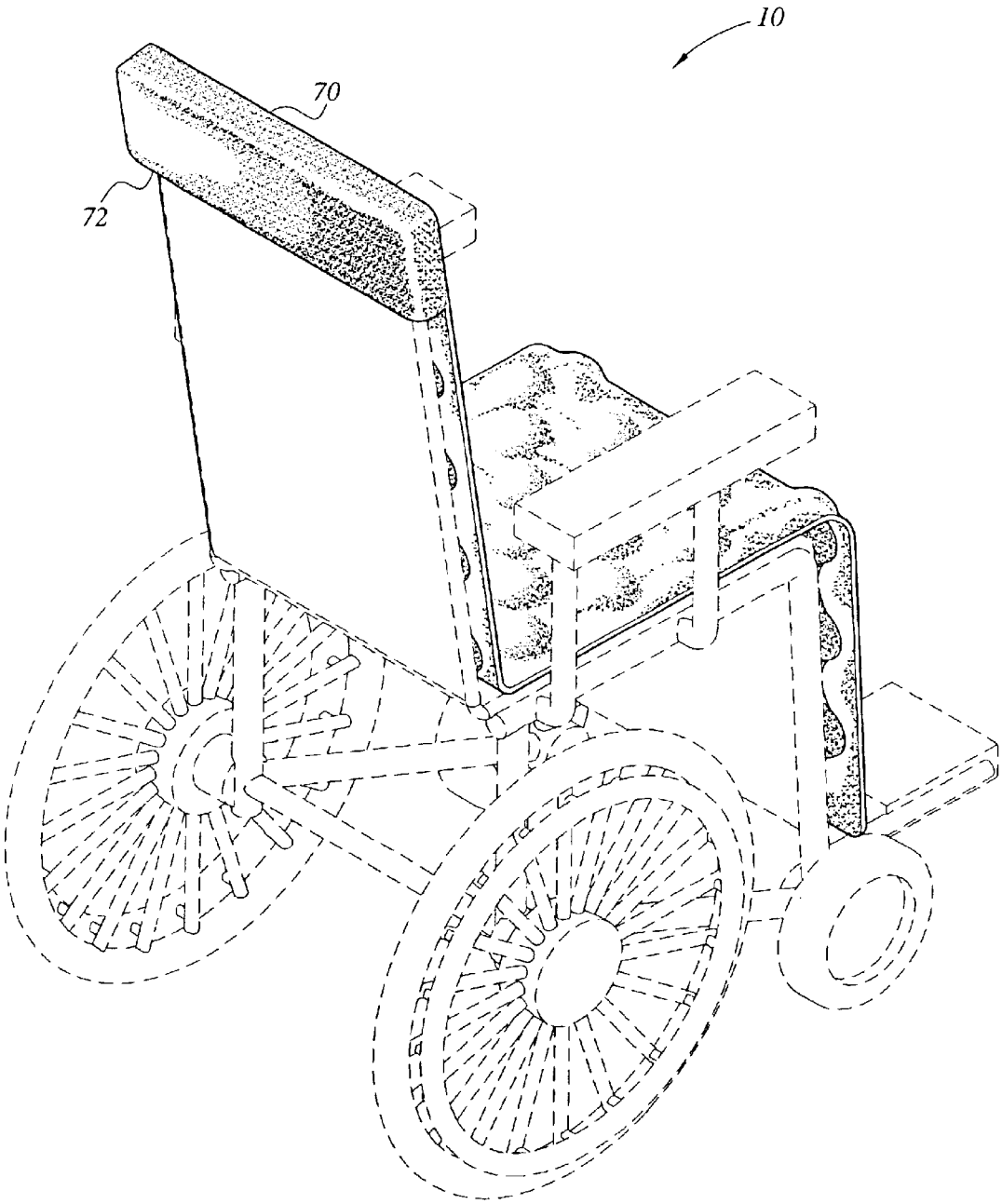
FIG. 3 is an environmental, perspective view showing a method of attaching the alternating pressure cushion to a seat back.

The alternating pressure cushion 10 is well suited for use in a hemodialysis chair or other reclining chair as shown In FIG. 1., or in a wheelchair or another similar type of chair as seen in FIG. 3. The alternating pressure cushion 10 is held in place on a chair back by hooks 74, or by a pocket 72 formed in the slipcover 70 which may be placed over a chair back.

It is to be understood that the present invention is not limited to the embodiment described above, but encompasses any and all embodiments within the scope of the following claims.

We claim:

1. An alternating pressure cushion, comprising:

a back cushion section having first and second back air-bladder networks, each back air-bladder network having an air filling tube connected thereto;

a seat cushion section, the seat cushion being flexibly joined to said back cushion section, the seat cushion section having first and second seat air-bladder networks, the first seat air-bladder network having first inflation means for inflating said first seat air-bladder network, the second seat air-bladder network having second inflation means for inflating said second seat air-bladder network; and a leg cushion section, the leg cushion section being flexibly joined to said seat cushion section, the leg cushion section having first and second leg air-bladder networks, the first leg air-bladder network having third inflation means for inflating said first leg air-bladder network, the second leg air-bladder network having fourth inflation means for inflating said second leg air-bladder network, the back, seat and leg cushion sections being pneumatically interconnected, and being separated by foldable seams, the back cushion section further comprising an air bladder adapted to provide lumbar support, said air bladder having an air filling tube connected to one of the air filling tubes of the air-bladder networks of the back cushion section.

2. The alternating pressure cushion according to claim 1, wherein:

said first inflation means for inflating said first seat air-bladder network is an air filling tube;

said second inflation means for inflating said second seat air-bladder network is an air filling tube;

said third inflation means for inflating said first leg air-bladder network is an air filling tube; and said fourth air filling means for inflating said second leg air-bladder network is an air filling tube.

3. The alternating pressure cushion according to claim 1, wherein said first inflation means for inflating said first seat air-bladder network comprises a first air-channel joining said first back air-bladder network to said first seat air-bladder network;

said third inflation means for inflating said first leg air-bladder network comprises a third air-channel joining said first seat air-bladder network to said first leg air-bladder network;

said second inflation means for inflating said second seat air-bladder network comprises a second air-channel joining said second back air-bladder network to said second seat air-bladder network; and said fourth inflation means for inflating said second leg air-bladder network comprises a fourth air-channel joining said second seat air-bladder network to said second leg air-bladder network;

whereby inflating said first back air-bladder network causes said first seat air-bladder network and said first leg air-bladder network to inflate; and whereby inflating said second back air-bladder network causes said second seat air-bladder network and said second leg air-bladder network to inflate.

4. The alternating pressure cushion according to claim 1, wherein said back cushion section, said seat cushion section, said leg cushion section, and said air-bladder networks comprise:

an upper sheet formed of an air-tight material;

a lower sheet formed of an air-tight material, the lower sheet being joined to said upper sheet by welded seems.

5. The alternating pressure cushion according to claim 1, further comprising a plurality of hooks disposed in said back cushion section, the hooks being adapted to support the alternating pressure cushion on a chair back.

6. The alternating pressure cushion according to claim 1, further comprising a slipcover covering the alternating pressure cushion.

7. The alternating pressure cushion according to claim 6, wherein said slipcover further comprises a pocket, the pocket being adapted to fit over a chair back to support the alternating pressure cushion.

* * * * *